United States Patent [19]

Heath

[11] Patent Number: 4,620,884

[45] **Date of Patent: * Nov. 4, 1986**

[54] HEAT TREAT PROCESS AND FURNACE

[75] Inventor: James E. Heath, Mississauga, Canada

[73] Assignee: Samuel Strapping Systems Ltd., Mississauga, Canada

[ * ] Notice: The portion of the term of this patent subsequent to Oct. 21, 1997 has been disclaimed.

[21] Appl. No.: 713,237

[22] Filed: Mar. 18, 1985

Related U.S. Application Data

[63] Continuation-in-part of Ser. No. 169,309, Jul. 16, 1980, abandoned, which is a continuation-in-part of Ser. No. 61,471, Jul. 7, 1979, abandoned.

[51] Int. Cl.[4] ..... C21D 1/54

[52] U.S. Cl. ..... 148/128; 266/87; 266/103

[58] Field of Search ..... 432/31, 32; 266/87, 266/249, 280, 286, 103, 102; 148/128, 153, 156

[56] References Cited

U.S. PATENT DOCUMENTS

| | | | |
|---|---|---|---|
| 3,496,033 | 2/1970 | Gilbreath, Jr. et al. | 148/128 |
| 3,862,397 | 1/1975 | Anderson et al. | 432/31 |
| 4,229,236 | 10/1980 | Heath | 148/128 |
| 4,243,441 | 1/1981 | Wilson | 148/128 |
| 4,443,509 | 4/1984 | Sauder | 266/280 |

OTHER PUBLICATIONS

Research Inc., Publication or Radiant Heating, undated.

*Primary Examiner*—L. Dewayne Rutledge
*Assistant Examiner*—S. Kastler

[57] ABSTRACT

The structure of the present invention rapidly heats metal strapping, wire and the like to a temperature in the range of about 800° F. up to about 1800° F. while maintaining accurate control on the final temperature using a simple control system. The heating process is also relatively simple and easily installed and controlled. The process and structure is easily adjusted for other applications such as paint drying. Short wave high intensity lamps have been closely spaced to provide for the rapid increase in product temperatures and gas flow through the heat zone maintains the structural elements at temperatures well below the heat treating temperatures and preferrably below about 500° F.

19 Claims, 6 Drawing Figures

FIG. 2.
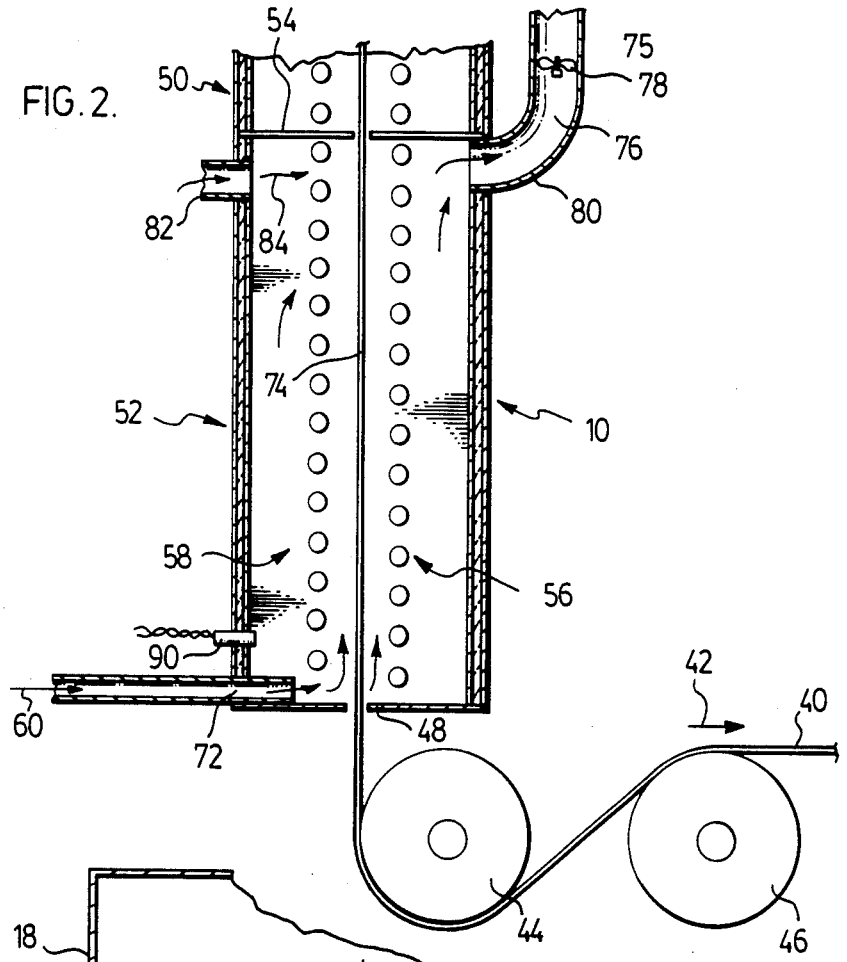
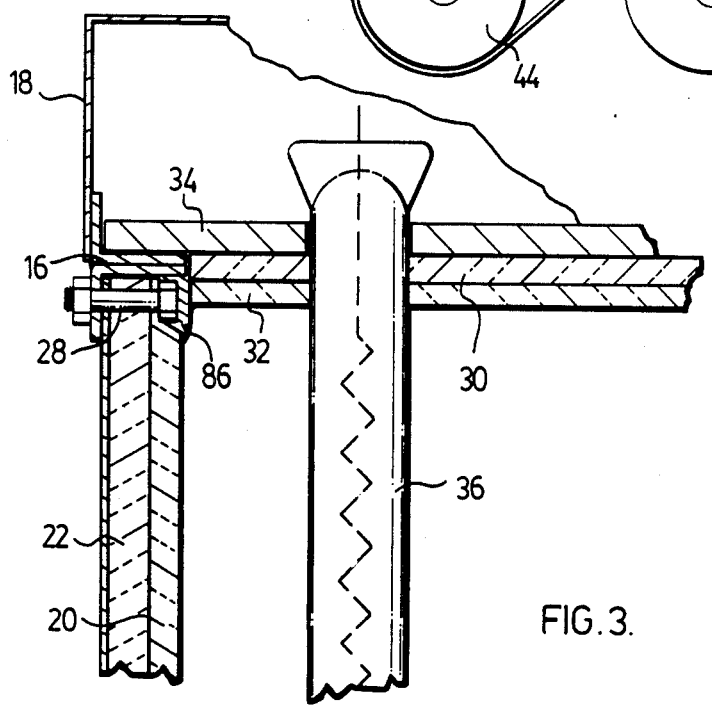
FIG. 3.

FIG. 4.
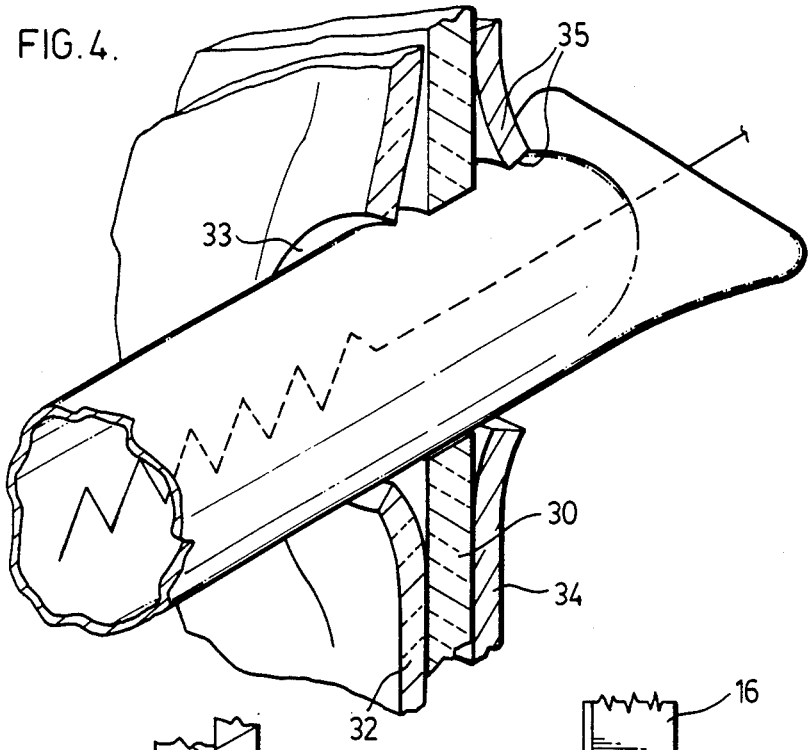
FIG. 5.
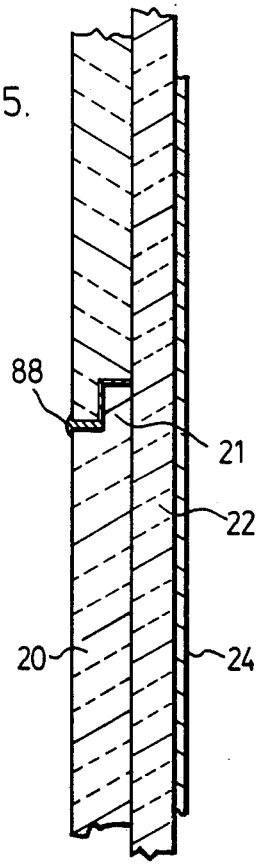
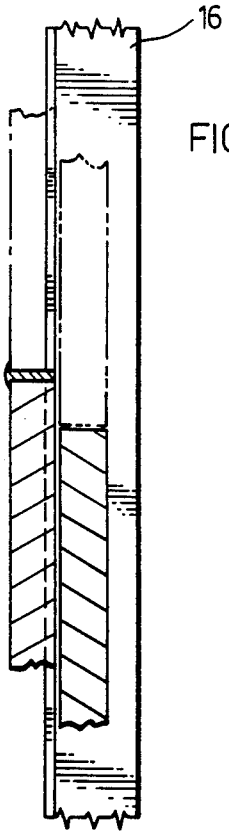
FIG. 6.

HEAT TREAT PROCESS AND FURNACE

This application is a continuation-in-part of application Ser. No. 06/169,309 filed 07/16/80 which is a continuation-in-part of Ser. No. 06/061,471 filed 07/07/79 both now abandoned.

BACKGROUND OF THE INVENTION

The present application is directed to a process and apparatus for treating of a heat treatable strap-like material by heating the same to a particular temperature as it is passed through a heat zone. In particular, the process and apparatus are advantageously used for heat treating of a ferrous metal product by raising the temperature thereof to a temperature in the range of about 800° to 1600° F. The process and apparatus result in precision heating of the material being treated by heating the same using high intensity infrared radiation in a controlled environment where the amount of heat input to the strap can be closely controlled.

Infrared radiation and particularly high intensity infrared radiation can be produced by elongate tubes as manufactured by General Electric and a number of applications have been suggested for this radiation as outlined in a Research Inc. brochure, entitled "Infrared Radiant Heat Invisible Tool for Today's Energy Conscience Industry".

In applying infrared radiation in continuous treating of heat treatable strapping and the like, problems occur with respect to lamp burn-out as the life of the lamp rapidly decreases with high operating temperatures and problems occur with respect to the structure for supporting the lamps particularly when a controlled atmosphere is required to avoid oxidization of the metal strap or the like, which is being treated. Heat treating of these products requires the temperture of the product to be raised in a range of 800° to 1800° F. or more and sealing problems between infrared radiation reflecting surfaces occurs due to the extreme temperature range the reflectors are subject to. As mentioned, this problem becomes acute when a controlled atmosphere is required whereby the structure must be designed to keep air and oxygen out of at least a portion of the heat treating zone.

The problems with respect to the operating temperature to which the structure is exposed is overcome in the application of the present process by providing a gas flow through the heat zone sufficient to frequently turn over the atmosphere within the heat zone to remove heat from the structure. In contrast to earlier processes, the atmosphere is frequently turned over to be relatively cool and there is no attempt to directly recycle the heat in the atmosphere back to the material being treated. The cool environment allows a net positive heat flow from the strap or material being treated to the atmosphere. Such an arrangement maintains a cool environment about the strap or product being treated whereby changes in the intensity of the radiation emitted by the lamps, both positive and negative cause a similar change in the energy absorbed by the strap and hence the temperature thereof. This results in a precise process and avoids damage caused by over heating of the strap due to secondary heat sources or due to momentary errors where the intensity emitted by the lamps is too great. It must be recognized that high intensity infrared radiation can rapidly raise the temperature of a thin substrate, such as strap or wire and the like, and, therefore, it is important to be able to have the temperature of the product responsive to positive and negative changes in the radiation emitted by the lamps.

Apparatus of the present invention discloses a simple structure for treating of the product where infiltration of ambient air is reduced to a point that it does not effect the product being treated. The apparatus provides a flow of inert gas over the product being treated as it is moved through the structure to envelop the strap and thereby avoid oxidization on the surface of the strap. Again, this flow of gas is such that it is at a temperature below that of the product being treated, at least when the product is near its final heat treat temperature where over heating of the strap or product could occur if the radiation emitted by the lamps is momentarily to high. This cool environment allows the temperature of the strap to be responsive to both positive and negative changes in the radiation emitted by the lamps. It can appreciated that when the strap or product is at a temperature much less than the final temperature being sought, it is not as important for the gas flow to be below the temperature of the product as a slight overshoot in the temperature would not be a problem, as it would still be below the final temperature to which the strap is be raised.

SUMMARY OF THE INVENTION

The process of the present invention is used in heat treating metal strapping wire and the like as the same is passed through a heat zone raising the temperature of the metal to a predetermined temperature range in the range of about 800° F. to 1600° F. depending upon the material being treated and the material property sought to be obtained.

The process comprises passing the metal to be treated through the heat zone along a generally straight path past opposed banks of high intensity infrared radiation lamps energing the lamps to produce high intensity short wave infrared radiation to heat the metal to be treated, sensing the temperature of the material adjacent the exit of the heat zone, controlling the intensity of radiation emitted by the lamps by varying the input energy to the lamps in accordance with at least the sensed temperature of the metal adjacent the exit of the heat zone to maintain the metal temperature at the exit of the heat zone within the predetermined range, introducing sufficient air into the heat zone to flow over and cool the lamps and maintain them within their normal operating temperature range and to cause a flow of air along and enveloping the material to be treated, prior to positively exhausting the air from the heat zone, the introduction and exhaust of air from the heat zone being sufficient to frequently turn-over the atmosphere within the heat zone and cause the air about the material being treated to be at a temperature causing a net positive heat flow from the material to be treated to the atmosphere whenever the material to be treated is at a temperature in excess of about 500° F.

The process for heat treating a heat treatable strapping wire or the like as the same is passed through a heat zone, raises the temperature of the ferrous metal to be in the range of about 800° to 1600° F., depending upon the material being treated and the material property sought to be obtained, and requires a controlled atmosphere to minimize oxidization on the surface of the metal being treated. The process comprises passing the metal to be treated through the heat zone along a generally straight path past opposed banks of infrared radiation lamps which provide the sole original heat source for determining the temperature to which said material is to heated. The lamps are energized to produce high intensity short wave infrared radiation to heat the metal and the temperature of the material adjacent the exit of the heat zone is sensed. This sensed temperature is used to control the intensity of the radiation emitted by the lamps by changing the input energy to the lamps in accordance with at least the sensed temperature to maintain the metal temperature at the exit of the heat zone within a predetermined range. A gas flow is introduced at the exit of the heat zone and flows along the metal being treated in a direction opposite the direction of travel of the metal being treated to provide a controlled atmosphere about the strap. The gas flow envelops the metal at least adjacent the exit of the heat zone and in the region where the material to be treated is at a temperature which would cause oxidization unless protected by the gas flow. The gas of the flow is non-oxidizing with respect to the metal being treated and preferrably is nitrogen. Air is introduced into the heat zone to cool the lamps and maintain a cool air environment at points which do not require a controlled atmosphere. Sufficient air and controlled atmosphere are positively exhausted at a position within the heat zone to provide a pressure differential between the exit of the heat zone and the exhaust position which results in the gas flow along and enveloping the material to be treated. The exhaust of air and gas from the heat zone is sufficient to frequently turn over the atmosphere within the heat zone and to retain the atmosphere about the material being treated at a temperature causing a net heat flow from the material to be treated to the atmosphere at least adjacent the exit of the heat zone.

According to an aspect of the invention, the gas introduced, at least adjacent the exit of the heat zone, is nitrogen gas at an appropriate pressure and temperature to expand at least about three times in volume to the exhaust pressure and, thereby, displace and maintain exhaust air out of contact with the strap having a temperature which could cause oxidization if exposed to an oxidizing atmosphere.

According to a further aspect of the invention, the atmosphere within the heat zone is continually exhausted to cause a sufficient flow through the heat zone to maintain the structure thereof at a temperature less than about 500° F.

According to yet a further aspect of the invention, the process is capable of start-stop operation and includes the strap of purging at least the portion of the zone having the controlled gas atmosphere with a greater flow of gas upon stopping of the strap to immediately cool any hot spots within the heat zone produced by undesired continuous exposure to the radiation emitted for the purpose of heating of the material to be treated.

The heat zone, according to the present invention, comprises a opposed banks of high intensity infrared radiation lamps extending across the heat zone defined by opposed side walls and opposed end walls. The side walls include a length of ceramic blanket material exterior to ceramic board panels positioned in abutting relationship. The panels and blanket are secured to support members with the blanket being resistant to infiltration of ambient air and the panels having a reflective surface exposed within the heat zone for reflecting high intensity infrared radiation emitted by the lamps for heating of the material being treated.

According to an aspect of the invention, the end walls include opposed ceramic blankets each extending the length of the end walls separated by lamp support panels which receive the lamps and allow the same to pass therethrough for electrical connection to a supply exterior to the heat zone.

According to a further aspect of the invention, the lamps have extended tubes with each tube having a cathode and anode intermediate the length of the tube. The lamps are secured by the end walls with the anode and cathode between the end walls. This allows the anode and cathode to be fully exposed within the heat zone and to allow cooling thereof by the flow of gas atmosphere and/or air through the heat zone.

BRIEF DESCRIPTION OF THE DRAWINGS

Preferred embodiments of the invention are shown in the drawings wherein;

FIG. 2 is a partial side view of the heat zone structure which has been divided into two sections, one of which requires a controlled atmosphere;

FIG. 3 is a section taken along line 3—3 of FIG. 1;

FIG. 4 is a partial perspective view showing the support of the lamps within the end walls of the heat zone;

FIG. 5 is section taken along line 5—5 of FIG. 1; and

FIG. 6 is a cross section taken along line 6—6 of FIG. 1.

DETAILED DESCRIPTION OF THE PREFERRED EMBODIMENTS

Figure 1:
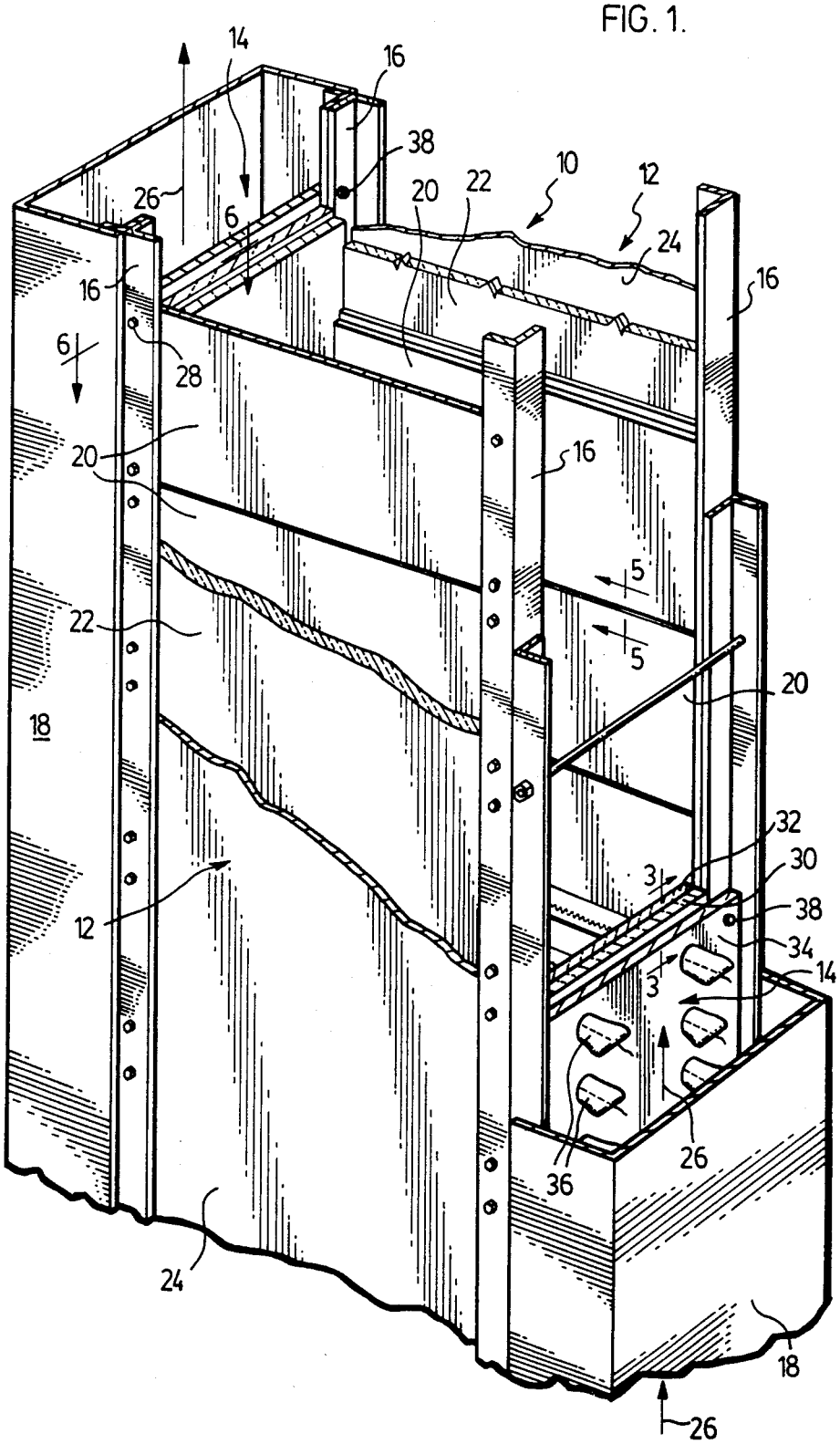
FIG. 1 is partial perspective view of the heat zone structure.

The heat treating zone structure 10 of FIG. 1, has opposed side walls 12 and opposed end walls 14 secured at the corners by generally vertically extending upright structural members 16. Beyond the end walls 14, and running generally parallel therewith are cover members 18 which define a conduit through which an air flow is forced as generally indicated by arrow 26. This air flow provides cooling of the end walls and provides cooling of the lamp tips to increase the life expectancy of the infrared radiation emitting lamps or tubes 36. Each side wall has a plurality of infrared reflecting panels 20, which define the interior surface of the side walls of the heat treating zone and reflect infrared radiation which inpinges thereon. Behind the infrared reflecting panels 20, is a continuous ceramic blanket 22 which extends from the bottom of the heat zone to at least a point where air infiltration into the interior of the heat zone is no longer critical. It is preferred that this ceramic blanket extends the full height of the heat zone which will have an inert gas atmosphere flowing therethrough. The ceramic blanket in combination with the operating pressure of the atmosphere within the heat zone, makes infiltration of ambient air to be minimal, if at all, and out of contact with the product requiring protection. Exterior to the ceramic blanket is a side cover made of steel or aluminum to prevent damage to the blanket. The panels 20, the ceramic blanket 22 and the cover 24 are secured by bolts 28, positioned at the corner of the panels and passing through the upright member 16.

The end walls 14, comprise transite panels 30 having apertures therein for receiving and supporting the infrared radiation emitting lamps 36. The transite panels are covered on the inside by a ceramic blanket 32 and covered on the exterior thereon by a ceramic blanket 34. The ceramic blankets 32 and 34 are slit to allow the lamps 36 to pass therethrough, in a manner that the ceramic blanket 32 and 34 engages the lamp and provides a seal therewith. The ceramic blankets 32 and 34 as well as the ceramic blanket 22 of the side walls are fairly flexible in their initial state, however, when exposed to the higher tempertures of the heat zone, they become somewhat more rigid and the flexibility is lost. This is not a problem as the lamps have already been put in place prior to exposing the ceramic blankets to the higher temperature, and replacement of a single lamp if necessary can still be accomplished. Nut and bolt arrangement 38, secure the ceramic blanket 34 and 32 as well as the transite panels 30 in place.

In building of the heat treat zone structure 10, the side walls are built by proper placement of the panels 20 and the ceramic blanket 22 with the end walls left open to provide access to the interior of the zone. After these components have been put in place, the ship lap joint, generally indicated as 21 in FIG. 5, between the panels 20 is filled on the interior surface with a sealing compound. This sealing compound is referred to in the trade as a moldable ceramic suitable for the maximum operating temperature of the zone and will be placed at the abutment of the ship lap joint of the panels 20 as well as at the corners of the panels and the upright members 16. After the side walls 12 have been properly assembled, the end walls are built up by proper securing of the transite panels 30, and the ceramic blanket 32 and 34. It has been found that the ceramic blanket 32 and 34 can be made of a $\frac{3}{8}$" thickness, whereas it is preferred that the ceramic blanket of the side walls be about $\frac{1}{2}$" in thickness. In addition, the panels 20 are manufactured by Crown Company Limited of St. Catherines and referred to as "M Boards 2600." These are approximately 1" thick, and will withstand temperature up to approximately 2600° F. It has been found that these boards tend to warp as they are exposed to temperatures approaching the miximum, and although the heat zone is not intended to heat the product to 2600° F., it has been found that these boards are superior with respect to maintaining their shape relative to similar boards having a maximum temperature of about 2000° F. These earlier boards were subject to warpage deformation and shrinkage rendering the structure prone to leakage of ambient air. The higher temperature boards are not as prone to shrinkage and warpage and the use of the ceramic moldable sealant to seal the panel joints, accommodates minor shrinkage, and tolerance variation, and assembly problems.

In FIG. 2, a product 40 that has been heat treated and passed about the exit rollers 44 and 46. The exit 48 of the heat zone structure 10, has a gas conduit 72 located for introducing an inert gas which is non-oxidizing relative to the product, such as strap wire and the like, which is being treated. The gas which is introduced as indicated by arrow 60, envelops the product being treated adjacent the exit of the heat zone, and continues to flow along the strap and protect the strap or product up until a point such as 74, which is within the second stage 52 of the heat treating structure 10. Point 74 has been arbitrarily selected, however, it represents a possible initial point where the strap is at a temperture which requires an inert gas atmosphere to prevent oxidation. The location of this point will be a function of the material being treated and the temperature of the product at this point. Point 74, is located below the air inlet 82 to avoid oxidization of the product. An air flow 84 comes through the air inlet 82 and is exhausted by the exhaust fan 78, through the exhaust conduit 80. This provides a flow of ambient air across the heat zone and removes heat from beneath the baffle 54 which separates the second stage 52 of the heat zone treating structure 10, from the first stage 50. The first stage, due to the temperature to which the strap or product is being raised, up to about 900° F., does not require an inert atmosphere and, therefore, does not require the additional expense of maintaining a flow of inert gas along the product being treated to envelop the same. Also adjacent the exit 48 of the heat zone is an optical pyrometer 90, which senses the temperature of the strap and appropriately increases or decreases the input energy to the infrared radiation lamps 36, which have been arranged in opposed banks 56 and 58. The inert atmosphere such as nitrogen, is introduced through the gas conduit 72, and is at a temperature and pressure which will cause the gas introduced to expand at least about three times the volume to atmospheric pressure which is the pressure approximately at the exhaust conduit 80. Therefore, a positive pressure bias exists between the introduction of the inert gas at adjacent the exit 48 and the point of exhaust from the heat zone indicated adjacent conduit 80, and the heat zone is at a pressure slightly above atmosphere. Similarily the exhaust conduit 80 causes the air flow 84 to be maintained in the upper region of the second stage of the heat zone and away from the point 74 requiring an inert gas atmosphere. It is preferred that the exit 48 of the heat zone 10 is the point of introduction of the inert gas and separates the heat zone from other structures, such as a lead bath which could be immediately below the exit 48. It is preferred to introduce the strap directly into a lead bath, however, fumes from the lead bath are preferrably not introduced into the heat zone as they can contaminate the quartz tubes of the lamps and cause a rapid decrease in the life expectancy of the lamps. For example, it has been found that fumes from the lead bath can contaminate a small point on a lamp and cause the same to burn through the quartz destroying the tube. It is preferred that the gas within the heat zone be physically separated from other structures, even though the structures below the heat zone will probably also require a controlled atmosphere. Possibly the same gas inlet could be used for both, however, they should be separately exhausted, and the gas above the lead bath should not flow into the heat zone and contact the lamps.

The lamps 36, as shown in FIG. 3, are of an extended length where the tungston filament of the tube is located substantially intermediate the length of the tube. This allows the tube to pass through the ceramic blanket 32, the transite panel 30 and the ceramic blanket 34 with the filament located intermediate the end walls of the heat zone. The life expectancy of the lamps 36 can be substantially increased by positioning the filament intermediate the end walls of the heat zone as the heat thereof can be dissipated along the tube and removed by the gas flow moving past the lamps.

Further cooling of the lamps is provided by the gas flow between the end walls and the cover 18. It has been found that with the high intensity radiation emitted by and the close spacing of, the lamps, that clear quart tubes are preferred rather than frosted quartz. It is believed that the clear quartz is not as prone to hot spots within the length of the tube which result in small pin holes occurring after use of the tubes. It has also been found that it is preferrable to use lamps of higher voltage capacity, such as capable of a voltage in the range of about 270–280 volts, such that the lamps do not run at maximum output at all times. The life expectancy of the lamps can be significantly increased if the output thereof is more in the range of 75% of maximum output, rather than very close to maximum output which would be required with lamps having a voltage capacity of 220–240 volts. It has been found that if contamination of the lamps should occur, the lamps must be thoroughly cleaned and the life expectancy of the lamps will decrease substantially should the lamps be run without cleaning, under the false impression that the contamination will burn off. What has been found is that small pin holes occur at points of contamination and the lamp will be ruined.

In a stop/start heat treating application it has been found that if the line is stopped the second stage of the heat zone should be immediately purged with an additional flow of gas to remove heat from the heat zone and to avoid structural hot spots which could cause localized damage of the strap or product being treated. Nitrogen gas is preferrably introduced at the rate of approximately 260 SCFM at a pressure of about 50 PSI and a temperature of about 80° F. to cool the structure and lamps to a temperature of about 400° F. or less. The normal running temperature of the structure other than the lamps is about 500° F. or less. The exhaust fan exhausts the gas atmosphere and the introduced ambient air at the rate of approximately 3000 CFM. This results in heat being removed from the heat zone structure to an extent that the actual structure has an average temperature quite low and the outer walls of the heat treating zone have a temperature of about 100° F. The structural components can be made of aluminum and, therefore, the temperature thereof must be kept well below 600° F., which could result in structural failure.

The exhaust fan 78, causes a slight negative pressure adjacent the inlet to the exhaust conduit 80, whereby a pressure bias exists between the introduced gas 60 and the slight negative pressure adjacent the exhaust conduit 80. This slight negative pressure also provides a pressure bias urging the air flow across baffle 54 to remove heat therefrom and maintains the air flow above point 74 requiring the inert gas atmosphere. The structure of the side walls and end walls results in an essentially air tight structure and leakage of ambient air is further minimized as the structure is under a minimal positive pressure due to the introduced nitrogen.

The heat zone structure may require rebuilding from time to time, such as lamp replacement or lamp cleaning, as but one example, and in this case the end walls are removed and the side walls can normally remain intact. It has been found that the tower can easily be built by removing the transite panels 30 from the end walls, and upon rebuilding of the tower inserting the necessary lamps and using new ceramic blankets 32 and 34. In this way, the side walls of the heat zone remain intact and the down time for rebuilding of the heat zone structure is considerably reduced. It can also be appreciate that the lamps are easily inserted through the blankets as they only require slitting and do not require trimming.

It is important that both the inert gas atmosphere which flows through the heat zone structure and the ambient air flow which is introduced to exhaust heat be positively exhausted. Positive exhaust maintains sufficient cooling of the structure and maintains a relatively cool environment about the strap whereby the temperture of the strap is highly reactive to changes, both positive and negative in the input energy to the infrared radiation lamps. These lamps which are producing high intensity infrared radiation capable of rapidly raising the temperature of the strap several hundred degrees. Therefore, it is important that the strap be in an environment where the temperture of the strap at least when the strap temperature is in excess of about 500° F. (and preferably 350° F.) responds rapidly with changes in the level of radiation intensity. This precision is further required as the thickness of the material being treated is often quite thin and, therefore, the mass thereof is quite small which can result in the very rapid rising of this temperature if the strap did not directly respond with the input energy to the lamps. The atmosphere is frequently exhausted to assure a net positive heat flow from the material treated to the atmosphere flowing thereover at least when the material is at a temperature of about 500° F. or more. The lamps are very fast reacting to changes in their energy input level which is controlled by the optical pyrometer 90. The optical pyrometer 90, senses the exit temperature of the strap. By sensing this temperature and appropriately controlling the input energy of the lamps, it has been found that the final strap temperature can be maintained within a very narrow range, for example, approximately plus or minus 10 degrees or 5°, and allows very accurate control of strap temperature and hence acurate control of the property sought to be desired in the material. The flow of cool gas over the product being treated allows stop/start operation without the product exceeding the maximum temperature of the predetermined range, as the radiation of the lamps can be interrupted immediately resulting in an immediate end to a rise in product temperature as heat is constantly flowing to the atmosphere at least adjacent the exit of the heat zone.

The entire heat zone could have a flow of inert gas therethrough and it is not essential that air be introduced into the heat zone for removing heat therefrom. However, the cost for such a structure and process would be higher and can be partially avoided by providing an ambient flow of air across or along the strap at a position which does not require the controlled atmosphere, by appropriately restraining the flow so that it cannot contaminate the strap being treated at a temperature which requires the controlled atmosphere. In the structure shown in FIG. 2, the flow of nitrogen gas over the strap is in a direction opposite to the direction strap travel and the flow of nitrogen will tend to maintain the flow of ambient air in the upper region of the second stage of the heat zone. The gas so introduced is at the lowest temperature when the material being treated is at the highest temperature resulting in a higher net heat flow to the atmosphere adjacent the exit of the heat zone where temperature overshoots due to slow response to changes in radiation emitted would be particularly troublesome.

This structure is advantageously used in combination with a quench bath or controlled cooling if necessary, to obtain the desired properties. The heating zone is capable of raising steel strapping wire and the like to a temperature of about 1800° F. while the same is passed through the tower. Typical strap speeds of 110 to 150 feet per minute can be achieved for a strap gauge of 0.015" to 0.030" with a tower of a length of about 25 feet, raising the temperature of the strap to about 1600° F. The tower has 820 lamps horizontally disposed in opposed banks with a vertical spacing between lamps of about 1.5" to 2" and a horizontal spacing between lamps of about 8". The lamps are of the T3 type high intensity short wave radiation lamps sold by Sylvania or General Electric. Higher speeds can be achieved by lengthening the tower or running the system close to maximum. The above speeds are achieved at about 75% of full power. For stress relieving requiring a final temperature of about 1000° F. speeds for the same gauge strap and tower length would be about 150 feet per minute to 275 feet/min. The product to be treated is raised to the desired temperature in less than about 20 seconds.

In the continuous processing of steel strapping wire, tubing, sheet material, the present process and apparatus automatically accommodates changing speeds below a predetermined maximum, changing reflective properties with respect to short wave infrared radiation, changing gauges between different products to be treated, changing gauge of product as it is treated changing ambient, once the product has been brought up to operating speed. The optical pyrometer measures final temperature and automatically appropriately varies the input energy to the lamps. According to one embodiment, only about the final third of second stage of the heat zone are controlled by the pyrometer as the other lamps merely serve to bring the product up to a temperature close to the desired temperature for completion by the remaining controlled lamps.

Although various preferred embodiments of the present invention have been described herein in detail, it will be appreciated by those skilled in the art, that variations may be made thereto without departing from the spirit of the invention or the scope of the appended claims.

The embodiment of the invention in which an exclusive property or privilege is claimed are defined as follows:

1. A process for heat treating metal strapping, wire or strip material, as the same is passed through a heat zone raising the temperature of the metal to a predetermined temperature range in the range of about 800° F. to 1600° F. depending upon the material being treated and the material property sought to be obtained, at least a portion of said process requiring a controlled atmosphere to minimize oxidation on the surface of the metal being treated, said process comprising passing the metal to be treated through the heat zone along a generally straight path past opposed banks of high intensity infrared radiation lamps which provide the sole original heat source for determining the temperature to which said metal is to be heated, energizing said lamps to produce high intensity short wave infrared radiation to heat the metal to be treated, sensing the temperature of the material adjacent the exit of the heat zone, controlling the intensity of radiation emitted by the lamps by varying the sensed temperature of the metal adjacent the exit of the heat zone to maintain the metal temperature at the exit of the heat zone within said predetermined range, introducing a flow of a gas which is nonoxidizing with the metal being treated and cause the gas flow to be in a direction opposite to the direction of metal to be treated travel through the heat zone at least adjacent the exit of the heat zone, said gas flow enveloping said metal at least adjacent the exit of the heat zone and in the region where the material to be treated is at a temperature which would cause oxidation unless protected by the controlled atmosphere, introducing sufficient air into the heat zone to cool the lamps and at points which do not require a controlled atmosphere and positively exhausting sufficient air and the controlled atmosphere at a position within the heat zone to provide a pressure differential between the exit of the heat zone and the exhaust of air and gas causing said gas flow along and enveloping the material to be treated, continuously replacing the atmosphere within the heat zone at a rate sufficient to maintain the atmosphere about the material being treated at a temperature of about 500° F. or less.

2. A process as claimed in claim 1, wherein said gas is nitrogen gas introduced under appropriate pressure and temperature conditions to expand at least about 3 times in volume to the exhaust pressure and thereby displace and maintain exhaust air out of contact with the strap having a temperature which would cause oxidation if exposed to an oxidizing atmosphere.

3. A process as claimed in claim 2, wherein nitrogen gas is introduced at a temperature of about 80° F. and a pressure about 50 psi and a flow rate of at least about 260 SCFM.

4. A process as claimed in claim 1, wherein the atmosphere within the heat zone is continually exhausted in sufficient amounts to maintain the structure of the heat zone other than the lamps at a temperature less than about 500° F.

5. A process as claimed in claim 1, capable of start/-stop operation and including the step of purging at least the portion of the zone having the controlled gas atmosphere with a greater flow of gas upon stopping of the strap to immediately cool any hot spots within the heat zone produced by the undesired continuous exposure to the radiation emitted for heating of the material to be treated.

6. A process as claimed in claim 1, including dividing the heat zone into two regions the first region having an air atmosphere and initially heating the strap to a temperature below about 900° F. and a second region for heating the strap to the desired temperature and having a controlled atmosphere, and continually exhausting the atmosphere of both regions to maintain a cool atmosphere and structure through which the strap passes.

7. A heat treating zone comprising opposed banks of high intensity infrared radiation lamps extending across a heat zone defined by opposed sidewalls and opposed end walls, said side walls including a length of ceramic blanket material exterior to ceramic board panels positioned in at least abutting relationship, said panels and blanket being secured to support means, said blanket being resistant to the infiltration of ambient air and said panels having a reflective surface exposed within said heat treating zone for reflecting high intensity infrared radiation emitted by said lamps for heating of the material being treated.

8. A heat treating zone as claimed in claim 7, wherein the end walls are made of panels to which a ceramic blanket is secured intermediate said panels and said end walls said lamps being supported in holes in said end walls, and extending therethrough for electrical connection to an electrical supply.

9. A heat treating zone as claimed in claim 7, wherein said lamps include extended tubes each tube having a filament intermediate the length of said tube, said tube secured by said end walls with said filamentd cathode between the end walls.

10. A heat treating zone as claimed in claim 9, wherein said lamps are cooled by a flow of oxidizing inert gas to remove heat therefrom, said flow of gas being exhausted with the ambient air.

11. A heat treating zone as claimed in claim 7, wherein said panels are joined together by overlapping edge regions.

12. A heat treating zone as claimed in claim 11, wherein said edge regions have a ship lap profile.

13. A heat treating structure for raising the temperature of metal strip material as it is moved along a predetermined path spaced comprising four parallel vertically extending upright members defining the corners of the rectangular in cross section heat treating structure having opposed side walls and opposed end walls, said side walls including a layer of ceramic blanket material extending the length and width of the side walls and an inner surface formed by ceramic infrared radiation reflecting panels in abutting relationship to form an essentially continuous reflecting surface across the width of and extending the length of said side walls, said panels and said blanket being secured to said upright members, each end wall including an outer layer of ceramic blanket material and an inner layer of ceramic blanket material each layer extending across and extending the length of the end wall and a plurality of abutting panels interior to said blanket materials and having appropriately positioned and sized holes therein for supporting infrared radiation lamps generally horizontally and closely spaced to extend between said end walls and pass therethrough, said blanket materials adjacent each of said lamps being slit through which one of said lamps extend to be exposed exterior to said heat treating structure and exterior to said blanket materials, said blanket materials and said panels being secured to said vertical upright members, each of said end walls having an associated cover member defining a conduit between said end wall and said cover through which air is forced to cool said end wall and the portion of said lamp extending through said panels and blanket materials, each of said side walls including a metal sheet material exterior to said blanket material for defining the outer surface of said sidewall.

14. A heat treating structure as claimed in claim 13, including means for introducing gas under pressure at the exit of said treating structure and means for exhausting gas from said structure at a position to cause a flow of said introduced gas along the strip material to envelop the same as the material moves from a predetermined position intermediate the structure to the exit thereof, said predetermined position being dependent upon the position of the exhaust means and the pressure and amount of gas introduced at the exit of the heat zone.

15. A heat treating structure as claimed in claim 13, including purging means for introducing additional gas to rapidly dissipate heat within said structure and lower the termperature thereof to less than about 400° F. when the material being treated is stopped within said structure.

16. A process for heat treating metal strapping wire or strip material as the same is passed through a heat zone raising the temperature of the metal to a predetermined temperature range in the range of about 800° F. to 1600° F. depending upon the material being treated and the material property sought to be obtained, said process comprising passing the metal to be treated through the heat zone along a generally straight path past opposed banks of high intensity infrared radiation lamps emergizing said lamps to produce high intensity short wave infrared radiation to heat the metal to be treated, sensing the temperature of the material adjacent the exit of the heat zone, controlling the intensity of radiation emitted by the lamps by varying the input energy to the lamps in accordance with at least the sensed temperature of the metal adjacent the exit of the heat zone to maintain the metal temperature at the exit of the heat zone within said predetermined range, introducing sufficient air into the heat zone to flow over and cool the lamps and maintain them within their normal operating temperature range and to cause a flow of air along and enveloping the material to be treated, prior to positively exhausting the air from the heat zone continuously replacing the air within the heat zone at a rate sufficient to maintain the air about the material being treated at a temperature of about 500° F. or less.

17. A process as claimed in claim 16, wherein the material to be treated is maintained within a plus or minus 10° F. of the desired temperature at the exit of the heat zone and without direct sensing of, automatically adjusts for the following:

variations in product speed within the desired operating range, variations in product thickness, variations in reflective characteristics of product to infrared short wave infrared radiation and changes in termperature of product as it is introduced into the heat zone.

18. A process as claimed in claim 17, wherein the product being treated is exposed to radiation for less than about 20 seconds at normal operating speed.

19. A process as claimed in claim 16, capable of stop/-start operation without any of the product being treated reaching a temperature greater than the maximum of the predetermined range.

* * * * *